United States Patent [19]

Goodwill et al.

[11] Patent Number: 4,897,646

[45] Date of Patent: Jan. 30, 1990

[54] METHOD AND APPARATUS FOR REDUCING THE EFFECTIVE BANDWIDTH OF ULTRASONIC WAVEFORM FOR TRANSMISSION OVER A LOGGING CABLE

[75] Inventors: William P. Goodwill; Donald G. Kyle, both of Plano, Tex.

[73] Assignee: Atlantic Richfield Company, Los Angeles, Calif.

[21] Appl. No.: 291,525

[22] Filed: Dec. 29, 1988

[51] Int. Cl.[4] ..... G01V 1/00

[52] U.S. Cl. ..... 340/853; 340/854; 340/856; 367/81

[58] Field of Search ..... 340/853, 854, 855, 856, 340/857; 367/81

[56] References Cited

U.S. PATENT DOCUMENTS

| | | | |
|---|---|---|---|
| 3,977,245 | 8/1976 | Clark et al. | 340/856 |
| 3,991,611 | 11/1976 | Marshall et al. | 340/857 |
| 4,012,712 | 3/1977 | Nelligan | 340/857 |

*Primary Examiner*—Charles T. Jordan
*Assistant Examiner*—J. Woodrow Eldred
*Attorney, Agent, or Firm*—Geoffrey A. Mantooth

[57] ABSTRACT

A method and apparatus for increasing the effective bandwidth of an acoustic return resulting from logging operations. The real time acoustic return is stored in memory. A transmitted acoustic return is produced for transmitting over a logging cable by transmitting the acoustic return out of the memory and onto the cable at a rate which is slower than real time.

9 Claims, 3 Drawing Sheets

OPERATOR INTERFACE
AMPLITUDE SAMPLE & HOLD
DISPLAY
LOGGING CABLE INTERFACE
RECEIVER
DEPTH INSTRUMENTATION
ANALOG MASS STORAGE
35
47
37
43
45
39
41
15
17
29
11
25
33
49
13
19
33
31

49
27
25
13
19
33
21
23
27
31

METHOD AND APPARATUS FOR REDUCING THE EFFECTIVE BANDWIDTH OF ULTRASONIC WAVEFORM FOR TRANSMISSION OVER A LOGGING CABLE

FIELD OF THE INVENTION

The present invention relates to methods and apparatuses for reducing the effective bandwidth of a waveform obtained from an ultrasonic logging apparatus to allow transmission of the waveform over a well logging cable.

BACKGROUND OF THE INVENTION

Zemanek, U.S. Pat. No. 3,369,626 discloses an ultrasonic tool for use in scanning the inner surface of an open well borehole or of casing in a borehole. The tool, which is commercially known as the "borehole televiewer", creates a high resolution picture of the inner surface under investigation. The borehole televiewer is used to "see" the inner surface under investigation through drilling mud or other borehole fluids. In an open borehole, the borehole televiewer provides a picture of the formations surrounding the borehole. In a cased borehole, the borehole televiewer provides a picture of the inner surface of the casing, which can be used to determine the condition of the inner surface.

The borehole televiewer uses a rotating ultrasonic transducer. The transducer serves as a transmitter, to generate acoustic waveforms, and a receiver, to receive the acoustic return. The acoustic return is caused by the reflection of the generated acoustic waveform from the inner surface under investigation. The acoustic return has two measured parameters, the time of travel of the acoustic return and the amplitude, which give an indication of the condition of the investigated surface.

The transducer rotates about three revolutions per second, is pulsed about 500 times per revolution, and is pulled up the borehole at a speed of about 5 feet per second. The ultrasonic transducer spot size, the rotational speed, the pulse repetition rate, and the vertical speed combine to provide full coverage of the investigated inner surface, resulting in high areal resolution of the inner surface.

Because of the large amount of information generated by the borehole televiewer and because the frequency of the acoustic waveforms is high, the bandwidth of the information is high. Unfortunately, the logging cable, which utilizes electrical conductors to connect the borehole televiewer to the surface equipment, has a limited bandwidth, thereby limiting the amount of information that can be transmitted over the logging cable. Fiber optic logging cables have the necessary bandwidth, but are too expensive and too easily damaged for general use.

Because of the limited bandwidth of the logging cable, the borehole televiewer is limited to transmitting the envelope of the acoustic return over the logging cable to the surface electronics.

Improvements in ultrasonic apparatuses allow investigations beyond the inner surface of the borehole. For example, as shown in Havira, U. S. Pat. No. 4,255,798, ultrasonic apparatuses are used to measure casing wall thickness and to evaluate the bond between cement and casing in a borehole.

It is thus desirable to transmit more information uphole than is contained in the envelope of the acoustic return. Although real-time signal processing is occurring downhole in the ultrasonic apparatus, it is desirable to record with the surface equipment the actual acoustic return. As more sophisticated methods of processing the acoustic returns are developed, these methods can be used to reprocess existing data, if the actual acoustic returns are recorded.

SUMMARY OF THE INVENTION

It is an object of the present invention to provide a method and an apparatus for reducing the effective bandwidth of an acoustic return, wherein the acoustic return can be transmitted over a cable having a limited bandwidth.

The present invention provides storage means for storing acoustic returns. The acoustic returns result from logging operations in a well borehole in which a logging apparatus generates an acoustic waveform and receives the resulting acoustic return. The received acoustic return is in real time and is stored in the storage means. The stored acoustic return is then transmitted over a logging cable at a rate which is slower than the real time acoustic waveform.

DESCRIPTION OF PREFERRED EMBODIMENT

Figures 1, 2:
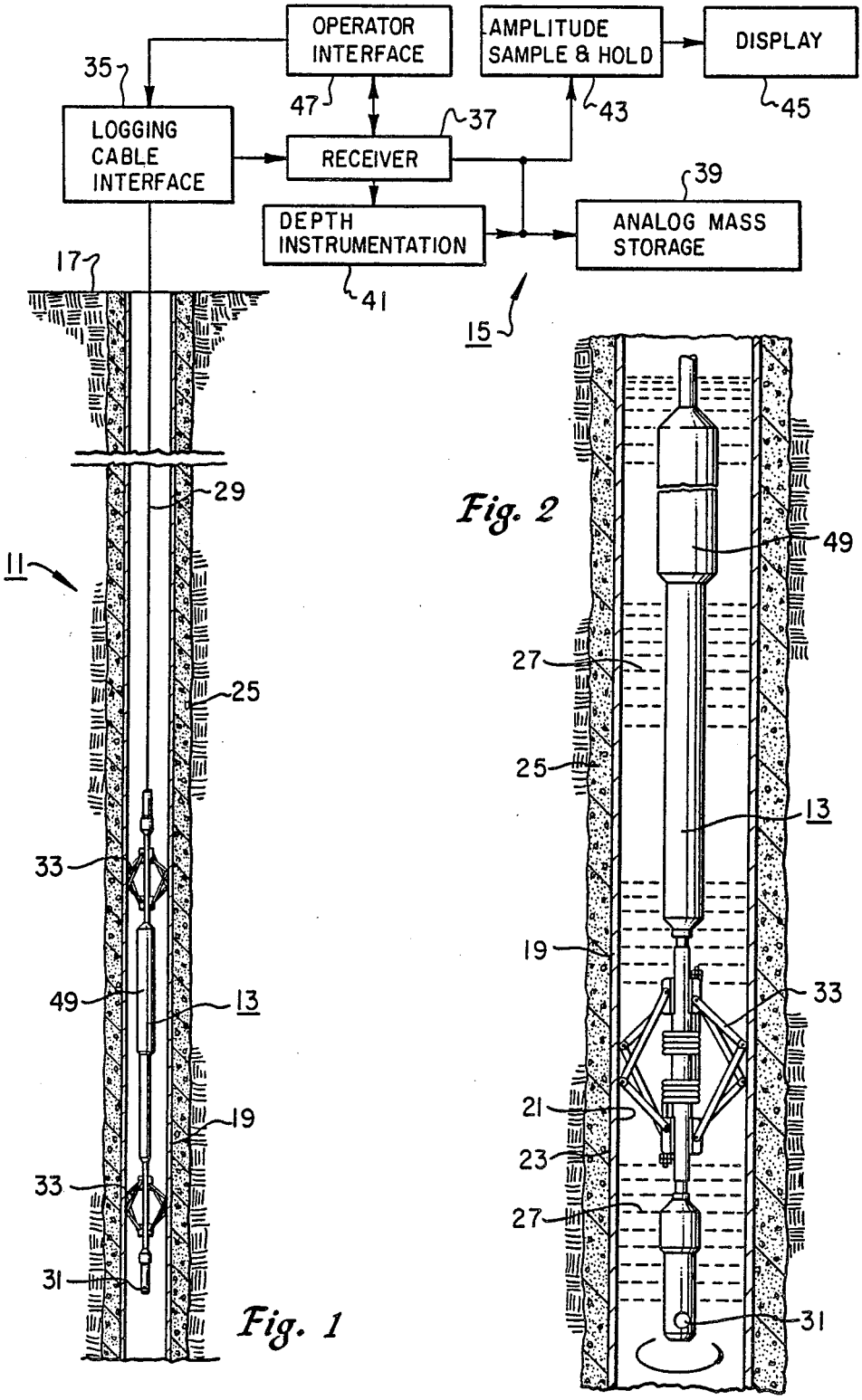
FIG. 1 is a longitudinal cross-sectional view of a cased well borehole, showing an ultrasonic tool therein, and surface electronics for the ultrasonic tool, with which the present invention in accordance with a preferred embodiment, can be practiced.
FIG. 2 is a detail view of portions of the ultrasonic tool of FIG. 1.

In FIGS. and 2, there is shown a schematic longitudinal cross-sectional view of a cased well borehole 11, showing an ultrasonic logging apparatus 13 located therein, and supporting surface equipment 15, with which the method of the present invention, in accordance with a preferred embodiment, can be practiced.

The well borehole 11, which is drilled into the earth 17, is for producing oil or natural gas. The well borehole 11 is lined with a length of casing 19. The casing wall has inner and outer surfaces 21, 23. Cement 25 fills the annulus between the casing 19 and walls of the borehole 11, for at least some of the length of the casing. The cement 25 is used primarily to isolate one formation from another. The interior of the casing is filled with borehole fluids 27, which may be drilling mud, oil, or both.

The logging apparatus 13 is located within the casing 19 and moves up or down the borehole for logging operations. The logging apparatus 13 is suspended inside of the casing by a logging cable 29, which provides electrical power and communication channels from the surface equipment 15. The logging apparatus 13 includes an ultrasonic transducer 31, which in the preferred embodiment, serves as a transmitter and a receiver. The transducer 31 is oriented so as to generate acoustic waveforms normal to the walls of the casing 19. In the preferred embodiment, the acoustical transducer has a resonant frequency of about 2 MHz and a and width of about 1.0–2.5 MHz. The logging apparatus is kept centered along the longitudinal axis of the casing by centralizers 33.

The logging apparatus 13 transmits data uphole to the surface equipment 15 over the logging cable 29. The surface equipment 15 includes a logging cable interface 35, a receiver 37, an analog mass storage unit 39, depth instrumentation 41, an amplitude sample and hold 43, a display unit 45, and an operator interface 47. The logging cable interface 35 receives signals transmitted over the logging cable 29 from the logging apparatus 13, and transmits signals from the operator interface 47 to the logging apparatus over the logging cable. The receiver 37 amplifies and decodes the signals from the logging apparatus. The receiver 37 sends the appropriate amplified and decoded signals to the analog mass storage unit 39 for storage. The receiver also sends the appropriate signals to the amplitude sample and hold unit 43, which is used to display relevant information on the display unit 45. The operator interface 47 allows the operator to adjust parameters (such as amplifier gain) of the surface receiver 37 and the logging apparatus electronics portion 49. The logging data, comprising time of travel and amplitude information is typically stored in the analog mass storage unit 39 for subsequent processing. However, processing equipment (not shown) can be brought to the borehole site to allow on-site processing of the data.

Figure 3:
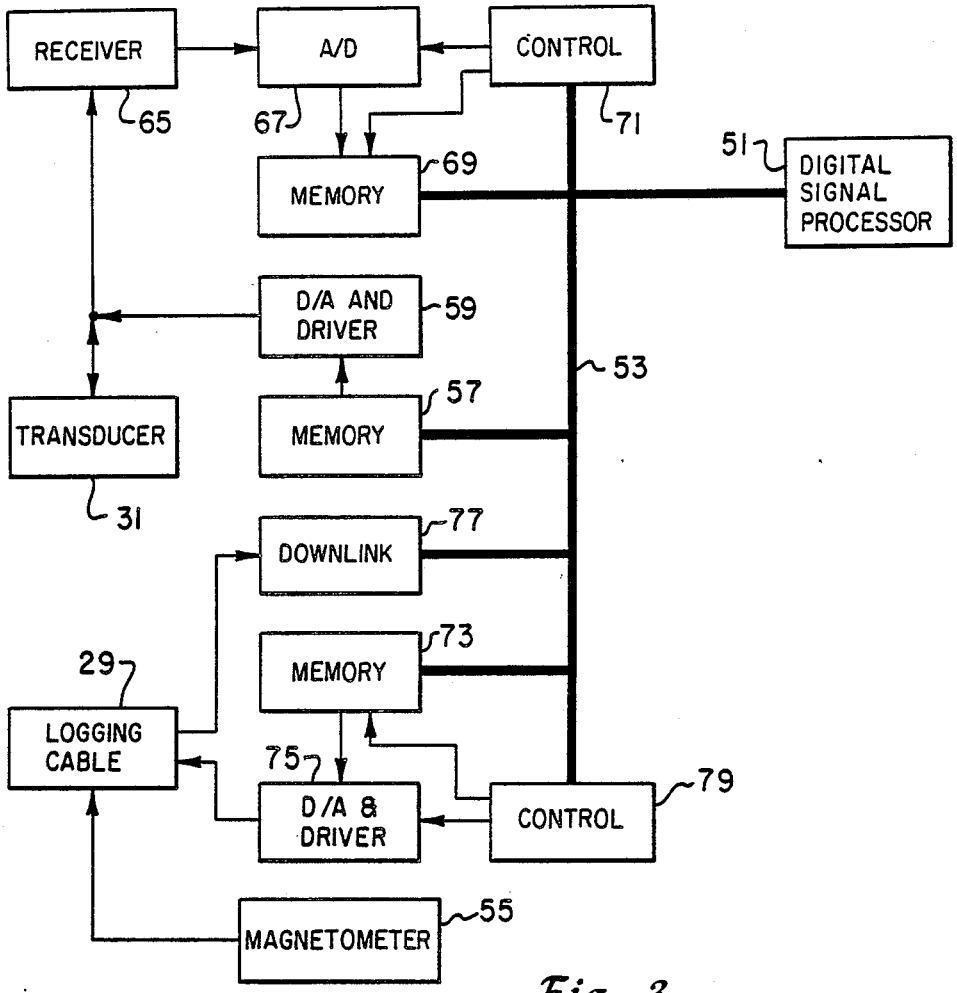
FIG. 3 is a block diagram of the downhole electronics unit which is located within the ultrasonic tool.

The electronics portion 49 of the logging apparatus 13, contains the downhole electronics (see FIG. 3). The downhole electronics interfaces with the transducer so as to produce and receive acoustic waveforms, and performs some preliminary processing of the data before being sent uphole. The electronics portion includes a digital signal processor 51, for performing control and processing functions. In the preferred embodiment, the digital signal processor is a TMS320C25 CMOS (complimentary metal oxide semiconductor) integrated circuit, manufactured by Texas Instruments. The digital signal processor is connected to the other units by way of a data bus 53. A magnetometer 55 provides information on the azimuthal orientation of the transducer 31 inside of the borehole 11.

The transducer 31 generates an acoustic waveform which is directed to the casing wall 19. The transducer 31 is excited by transmitter circuitry, which includes the digital signal processor 51, a transmitter memory 57, and a digital-to-analog (D/A) converter and driver 59. The digital signal processor 51 loads the transmitter memory 57 with a programmed waveform by way of the data bus 53. The transmitter memory 57, which is a first-in, first-out (FIFO) memory unit, outputs the programmed waveform to the D/A converter and driver 59. The D/A converter and driver 59 converts the digital waveform into an analog waveform and amplifies the waveform. The amplified waveform is sent to the transducer 31, where an acoustic waveform is generated. The transmitter circuitry excites the transducer on a periodic basis (e.g. 200 times per second).

Figure 4:
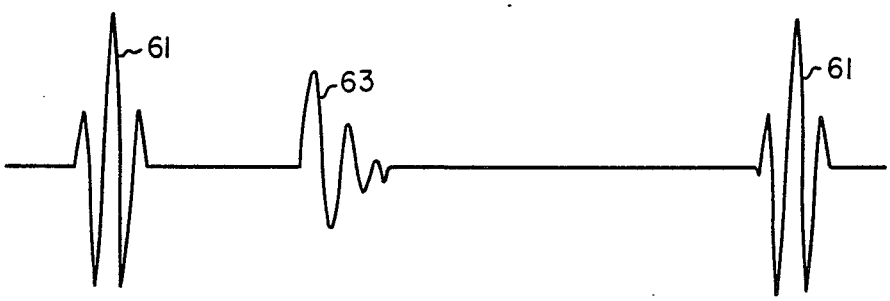
FIG. 4 is an ultrasonic waveform showing a transmitted waveform and its acoustic return.

The interaction of the generated acoustic waveform 61 on the casing wall produces an acoustic return 63 (see FIG. 4, where the amplitude of the acoustic return is not shown to scale with respect to the amplitude of the generated acoustic waveform). The acoustic return 63 includes a reflection portion which is caused by the reflection of the generated acoustic waveform 61 off of the inner surface 21 of the casing wall. The acoustic return is examined for an indication of the condition of the investigated casing wall portion. The acoustic return is received by the transducer 31 and receiver circuitry. The receiver circuitry includes a receiver 65, an analog-to-digital (A/D) converter 67, receiver memory 69, and a control unit 71. The receiver 65 filters and amplifies the acoustic return. The receiver 65 includes circuitry for protecting its amplifier from the transmitted waveform sent to the transducer 31 by the D/A converter and driver 59. The acoustic return is sent from the receiver to the A/D converter 67 where the signal is digitized. The digitized acoustic return is loaded into the receiver memory 69 which is a FIFO memory unit. The control unit 71 controls the initiation and termination of the digitizing process.

Data is transmitted to and received from the surface equipment 15 over the logging cable 29 by way of a downhole logging interface. The logging cable interface includes a memory unit 73 and a D/A converter and driver 75 for transmitting data to the surface equipment, and a downlink unit 77 for receiving data from the surface equipment. The memory unit 73 is a FIFO memory unit. A control unit 79 controls the rate of data transfer from the memory unit 73 to the D/A converter and driver 75, and also controls the conversion rate.

In the present invention, the acoustic return is transmitted uphole to the surface equipment 15 over the logging cable 29. The memory unit 73 and D/A converter and driver 75 form an arbitrary waveform generator for transmitting signals over the logging cable. The logging cable 29 acts as a distributed low pass filter. The actual bandwidth of any given logging cable is dependent on, among other things, the cable type and the length of the cable from the spool to the logging apparatus. Any high bandwidth waveform that is transmitted over the logging cable will be severely attenuated. By using the memory unit 73 and the D/A converter and driver 75, the effective bandwidth of the real time acoustic return 63 is reduced by stretching out the acoustic return over a longer period of time. The stretched acoustic return is then transmitted over the logging cable.

Figure 5:
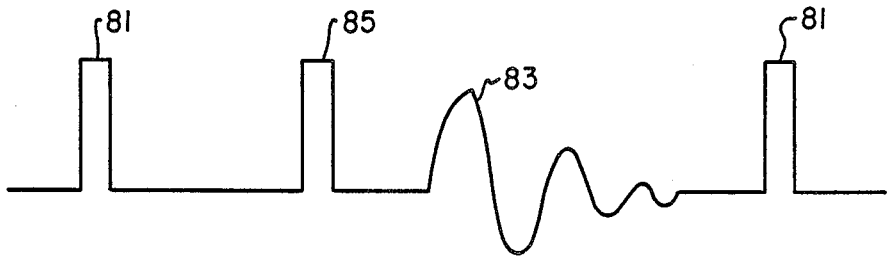
FIG. 5 is the signal produced by the present invention for transmission uphole over the logging cable.

The digital signal processor 51 coordinates the sequence of transmission of data over the logging cable 29. As the digital signal processor 51 initiates the production of the generated acoustic waveform 61 with the transmitter memory 57 and the D/A converter and driver 59, the digital signal processor causes the memory unit 73 and the D/A converter and driver 75 to produce a synchronous pulse 81 for transmission over the logging cable 29 (see FIGS. 4 and 5). The synchronous pulse 81 has a leading edge that is synchronous with the leading edge of the transmitter pulse 61.

When the real time acoustic return 63 is received by the receiver 65, it is digitized at a sample rate N and stored temporarily in the receiver memory 69. The digital signal processor 51 causes the digitized acoustic return to be transferred from the receiver memory 69 to the logging cable interface memory unit 73, over the data bus 53. Then, the digital signal processor 51, through the logging cable interface control unit 79, causes the memory unit 73 to unload the digitized acoustic return into the D/A converter and driver 75. The D/A converter and driver 75 converts the digital acoustic return into an analog signal 83 at an output data rate of N/K (where K is typically greater than or equal to 20), which is amplified for transmission over the logging cable 29. After unloading the acoustic return, the memory unit 73 is reset to zero its contents, in preparation for the next acoustic return. The control unit 79 controls the rate of conversion of the analog signal by the D/A converter and driver 75. The control unit 79 sets the conversion rate to be substantially slower than real time, in order to stretch out the acoustic return 63. The transmitted acoustic return 83 is lower in frequency by a factor of 1/K with respect to the real time acoustic return 63.

The digital signal processor 51 controls the initiation of conversion of the digitized acoustic return into an analog signal suitable for transmission. As shown in FIG. 4, there is an interval of time between the end of the real time acoustic return 63 and the initiation of the next generated acoustic waveform 61. This interval of time is normally unused or "dead" time. The stretched or transmitted acoustic return 83 can be expanded into this dead time interval. Because there is some processing and transfer lag, the initiation of the transmitted acoustic return 83 will lag behind the initiation of the real time acoustic return 63. The transmitted acoustic return 83 can be stretched to occupy varying portions of the dead time.

The amount of dead time can be controlled by the digital signal processor 51 which controls the periodicity of the generated acoustic waveforms 61. The length of time between adjacent generated acoustic waveforms 61 can either be programmed into the downhole electronics, or it can be changed during logging, wherein the surface equipment 15 can instruct the digital signal processor 51 of the periodicity. Having the ability to change the periodicity provides flexibility during logging operations. For example, the intervals of time between the generated acoustic waveforms can be increased to allow stretching of the transmitted acoustic return 83 over a longer time interval thereby providing for a lower bandwidth of the transmitted acoustic return.

The time interval over which the transmitted acoustic return 83 is stretched (or the rate of conversion by the D/A converter and driver 75) depends on the bandwidth characteristics of the particular logging cable being used. The smaller the logging cable bandwidth, the greater the interval of time the transmitted acoustic return 83 must occupy. Yet, it is desired to maintain the interval of time between generated acoustic waveforms as short as possible in order to speed logging operations. The bandwidth characteristics of an individual logging cable is best determined empirically, because each logging cable is electrically unique. In order to optimize logging speed and data transmission rates, the logging apparatus is operated during a trial run downhole, wherein the various parameters can be adjusted by way of the operator interface 47. Some attenuation of the transmitted acoustic return 83 may be permissible, depending on the characteristics of the surface receiver 37. After the trial run is completed and the parameters selected, the actual logging can begin.

The real time acoustic return includes a reflection portion and a reverberation portion. The reflection portion is caused by the reflection of the generated acoustic waveform off of the inner surface 21. The reverberation portion is caused by the reverberation of the generated acoustic waveform between the inner and outer surfaces 21, 23 of the casing wall. The transmitted acoustic return 83 need not contain all portions of the real time acoustic return 63. For example, the reflection portion of the real time acoustic return can be selected and transmitted over the logging cable. The reverberation portion can be discarded. Other information can be transmitted in the interval of time between the initiation of the real time acoustic return 61 and the initiation of the transmitted acoustic return 83. For example, the reflection portion has a time of travel which indicates twice the distance between the transducer 31 and the inner surface 21. The time of travel of the reflection portion is the interval of time between the initiation of the generated acoustic waveform 61 and the detection of the acoustic return. A time of travel pulse 85 can be transmitted uphole in the interval of time between the synchronization pulse 81 and the initiation of the transmitted waveform 83.

The foregoing disclosure and the showings made in the drawings are merely illustrative of the principles of this invention and are not to be interpreted in a limiting sense.

We claim:

1. A method of transmitting a waveform over a cable, said cable having a limited bandwidth, said waveform derived from an acoustic return from an ultrasonic logging apparatus operating in a well borehole, said ultrasonic logging apparatus generating an acoustic waveform at periodic intervals of time and receiving a respective acoustic return from the respective generated acoustic waveform, each of said acoustic returns being received in a first portion of said respective time intervals between said generated acoustic waveforms, said acoustic return having frequencies higher than said cable bandwidth, comprising the steps of:

(a) providing storage means for storing said acoustic returns, said storage means located in said ultrasonic apparatus;

(b) receiving said acoustic return in real time, and storing said acoustic return in said storage means;

(c) transmitting said stored acoustic return from said storage means over said cable at a rate of time which is slower than real time so as to effectively lower the high frequencies of said acoustic return to within said cable bandwidth, wherein said transmitted acoustic return is an analog waveform which is representative of said real time acoustic return and which has frequencies within said cable bandwidth.

2. A method of transmitting a waveform over a cable, said cable having a limited bandwidth, said waveform derived from an acoustic return from an ultrasonic logging apparatus operating in a well borehole, said ultrasonic logging apparatus generating an acoustic waveform at periodic intervals of time and receiving a respective acoustic return from the respective generated acoustic waveform, each of said acoustic returns being received in a first portion of said respective time intervals between said generated acoustic waveforms, said acoustic return having frequencies higher than said cable bandwidth, comprising the steps of:

(a) providing storage means for storing said acoustic returns, said storage means located in said ultrasonic apparatus;

(b) for each time interval, storing the respective acoustic return within said storage means at a first rate, said first rate corresponding to real time;

(c) for each interval, transmitting an analog waveform which is representative of the respective acoustic return over said cable during a second portion of said time interval, said second portion being later than said first portion, said transmitted waveform being transmitted from said storage means at a second rate which is slower than said first rate, said transmitted waveform having frequencies within said cable bandwidth, wherein the high frequencies of said acoustic return are effectively lowered to within the cable bandwidth.

3. An apparatus for transmitting a waveform over a cable, said cable having a limited bandwidth, said waveform derived from an acoustic return from an ultrasonic logging apparatus operating in a well borehole, said ultrasonic logging apparatus generating an acoustic waveform at periodic intervals of time and receiving a respective acoustic return from the respective generated acoustic waveform, each of said acoustic returns being received in a first portion of said time intervals, comprising:

(a) an analog-to-digital converter for converting said acoustic returns to a digital form;

(b) storage means for storing said digitized acoustic returns, said storage means connected with said analog-to-digital converter, said storage means comprising first-in-first-out memory means;

(c) a digital-to-analog converter for converting said acoustic returns stored in said storage means into analog form, said digital-to-analog converter connected with said storage means and with said cable;

(d) control means for controlling the rate of data transfer, said control means connected with said analog-to-digital converter, said storage means, and said digital-to-analog converter, for each time interval between generated acoustic waveforms said control means causing said digitized acoustic return to be stored in said memory means at a first rate corresponding to real time, said storing occurring during said first portion of said time interval; for each time interval said control means causing said digitized acoustic return to be unloaded from said memory means and converted into analog form for transmission on said cable by said digital-to-analog converter at a second rate, said second rate being slower than said first rate.

4. The method of claim 2 wherein said acoustic return has a bandwidth of at least 1 MHz and said second rate of time with which said transmitted waveform is transmitted over said cable is at least 1/20 as slow as real time.

5. The method of claim 2 wherein said acoustic return has a time of travel as measured from said generated acoustic waveform, further comprising the steps of:

(a) producing a synchronization signal and transmitting said synchronization signal over said cable, said synchronization signal being synchronized with said generated acoustic waveform;

(b) determining the time of travel of said acoustic return;

(c) producing a time travel signal at an interval of time from said synchronization signal corresponding to the time of travel of said acoustic return and transmitting said time travel signal over said cable;

(d) transmitting said analog waveform over said cable after transmitting said time travel signal.

6. A method of transmitting a received signal over a logging cable, said logging cable having a limited bandwidth, said received signal derived from a logging apparatus operating in a well borehole, said received signal having frequencies that are higher than said cable bandwidth, comprising the steps of:

(a) providing storage means for storing said received signal, said storage means located in said logging apparatus;

(b) receiving said received signal in real time and converting said received signal to a digitized form;

(c) storing said digitized received signal in said storage means;

(d) releasing said digitized received signal from said storage means and converting said digitized received signal to an analog waveform at a rate which is slower than real time, said analog waveform being expanded over time relative to said received signal and corresponding to said received signal, said slow rate being selected such that the high frequencies of said received signal are effectively located within said cable bandwidth, wherein said analog waveform effectively preserves said high frequencies of said received signal for reconstruction on the surface;

(e) transmitting said analog waveform over said logging cable.

7. A method of transmitting a received signal over a logging cable, said logging cable having a limited bandwidth, comprising the steps of:

(a) providing storage means for storing said received signals, said storage means located in said logging apparatus;

(b) producing pulses of generated energy from said logging apparatus, said pulses being produced at periodic intervals of time, each of said pulses producing a respective received signal that has frequencies that are higher than said cable bandwidth;

(c) receiving said respective received signals during said respective intervals of time between said pulses of generated energy, there being a subinterval of time between each of said received signals and the next respective pulse of generated energy;

(d) for each periodic interval of time, storing in real time said received signal within said storage means;

(e) for each periodic interval of time, transmitting an analog waveform which is representative of said respective received signal over said logging cable, said transmitted waveform being transmitted from said storage means at a rate which is slower than real time, said transmitted waveform being transmitted during said subinterval of time, said slow rate being such that said transmitted waveform is expanded over time relative to said respective received signal, wherein said high frequencies of said received signal are effectively lowered to be within the bandwidth of said cable;

(f) adjusting the amount of time in said periodic intervals of time between said pulses so as to adjust the amount of time in said subintervals of time to allow sufficient expanding of said transmitted waveform relative to said respective received signal to achieve the desired slow rate.

8. An apparatus for transmitting a received signal over a logging cable, said received signal derived from a logging apparatus operating in a well borehole, said logging cable having a limited bandwidth and said received signal having high frequencies that are located outside of said cable bandwidth, comprising:

(a) receiver means for receiving said received signal;

(b) storage means for storing said received signal in real time, said storage means connected with said received means;

(c) transmitter means for transmitting an analog waveform over said logging cable, said transmitted waveform being representative of said received signal, said transmitter means connected with said storage means so as to receive the contents of said storage means;

(d) control means for controlling the rate of transmission of said waveform, wherein said rate of transmission is slower than real time such that the high frequencies of said received signal are effectively lowered into said cable bandwidth, said control means connected with said storage means and said transmitter means.

9. The apparatus of claim 8, further comprising:

(a) generator means for generating pulses of energy from said logging tool, said pulses being produced at periodic intervals of time, each of said pulses producing a respective received signal;

(b) said receiver means receives said respective received signals during said respective intervals of time between said pulses of generated energy, there being a subinterval of time between each of said received signals and the next respective pulse of generated energy;

(c) said control means connected with said generator means and controlling the amount of time in said periodic intervals of time so as to adjust the amount of time in said subintervals of time to allow sufficient expanding of said transmitted waveform relative to said respective received signal to achieve the desired slow rate.

* * * * *